US005092605A

United States Patent [19]

Hoffman

[11] Patent Number: 5,092,605

[45] Date of Patent: Mar. 3, 1992

[54] METHOD OF PLAYING A RACING GAME

[76] Inventor: Charles L. Hoffman, 5431 Cherokee, Dearborn Heights, Mich. 48125

[21] Appl. No.: 648,748

[22] Filed: Jan. 31, 1991

[51] Int. Cl.[5] ..... A63F 3/00

[52] U.S. Cl. ..... 273/246; 273/274

[58] Field of Search ..... 273/246

[56] References Cited

U.S. PATENT DOCUMENTS

| | | | |
|---|---|---|---|
| 2,044,122 | 6/1936 | Michener | 273/246 |
| 2,823,919 | 2/1958 | Scruggs | 273/246 |
| 4,264,076 | 4/1981 | Duncan | 273/246 |

FOREIGN PATENT DOCUMENTS

| | | | |
|---|---|---|---|
| 724533 | 12/1965 | Canada | 273/246 |
| 548977 | 11/1942 | United Kingdom | 273/246 |

*Primary Examiner*—Benjamin Layno
*Attorney, Agent, or Firm*—Donald P. Gillette

[57] ABSTRACT

A method of playing a racing board game. The board comprises a race course having a starting position, a finish line and six lanes. The lanes are divided into a plurality of spaces. There are six distinguishable playing pieces and each player is assigned a playing piece and a lane. Six standard cubical dice, each die numbered from "1" to "6" to correspond to the six playing pieces, are used to determine movement of the playing pieces. The board further comprises shaded spaces on the lanes and six separate storage locations for placing chips. The storage locations correspond to the six finishing positions, e.g. 1st place, 2nd place, . . . , 6th place. When a playing piece lands on a shaded space, that player, to his advantage, must place a chip in a storage location in which he thinks his piece will finish the race. As the race progresses, the player whose piece crosses the finish line first is given all the chips stored in the storage location corresponding to 1st place. As successive pieces reach the finish line, the players likewise receive all the chips in the storage locations corresponding to their respective finishing order. The player with the most chips wins.

20 Claims, 1 Drawing Sheet

METHOD OF PLAYING A RACING GAME

BACKGROUND OF THE INVENTION

This invention relates to a racing game in which playing pieces are moved along a track in response to random generation of movement information, and each player receives a score according to scoring data at a storage location that corresponds to the order in which the piece assigned to that player crosses a finish line. In particular, the invention relates to a racing game in which the scoring data stored at each storage location consists of value markers contributed by the players during the game in response to triggering events that require the players to select a storage location and to store a value marker at that location. The winner is not necessarily the player whose piece finishes first but the one who receives the highest score.

OBJECTS AND SUMMARY OF THE INVENTION

The game of this invention is played on a race course that has a starting position and a finish line and is preferably divided into a plurality of lanes, one for each playing piece. Each lane is divided into unit distances of travel. A playing piece identified by a number or other indicia is given to each player for the duration of the game, and each piece is assigned to travel along one of the lanes. The game apparatus includes random-choice generating means to be actuated at each turn to generate indicia corresponding to the indicia on the pieces, and only those pieces whose indicia is thus generated at a given turn are to be moved at that turn.

If the random-choice generating means are standard dice, a playing piece bearing the indicium "3", for example, would move only if at least one die came to rest indicating "3" on its uppermost facet. Preferably, there are as many dice as playing pieces, and the distance moved by a given piece corresponds to one unit distance for each die showing the indicium of that piece on it uppermost facet.

An important element of chance is introduced into the game by providing storage means with separate storage locations in which to store value markers as scoring data, each such location corresponding to a finishing position, or order, in the race, i.e., 1st place, 2nd, 3rd, etc. During the game, triggering events may occur to any player's piece requiring that player to choose one of the storage locations and place a value marker, such as a poker chip, in it. Such an event could be the landing of that piece on a marked location in its lane.

As the race progresses, the player whose piece crosses the finish line first is given all of the markers stored in the location corresponding to 1st place. As successive pieces reach the finish line, the players to whom they are assigned likewise receive all of the markers in the storage locations corresponding to their respective finishing order. The player who receives the most markers wins, and this can easily be a player whose piece finishes far behind the piece that finished first.

The game can also be set up so that, upon the occurrence of another type of triggering condition, playing pieces selected by the random generating means will have to move differently, for example backward by a certain distance, thus increasing the total effective distance those pieces will have to travel. This triggering condition may also require the player to contribute a value marker to any selected one of the storage locations. Still further requirements may be triggered off during the game.

DESCRIPTION OF A PREFERRED EMBODIMENT

Figure 1:
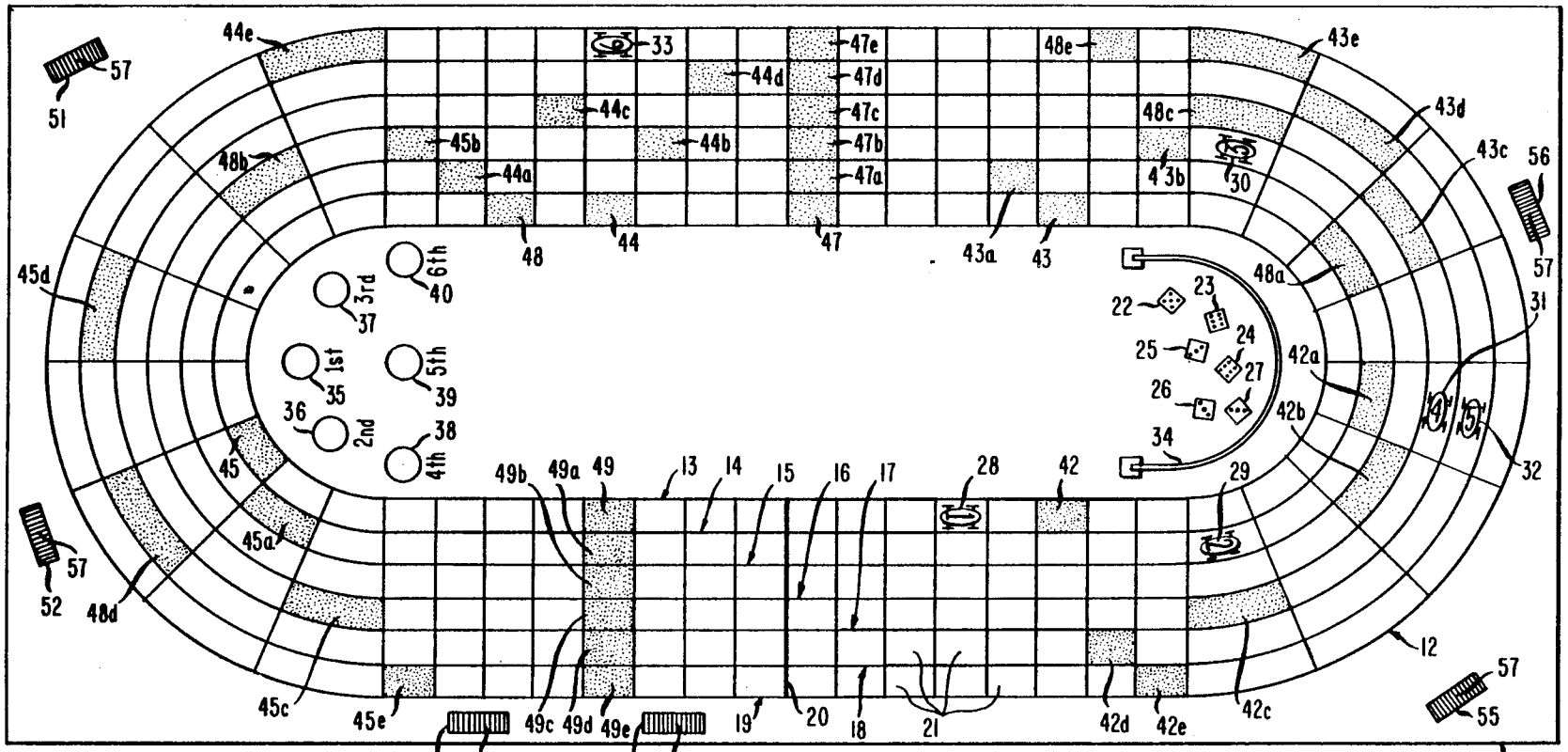
FIG. 1 is a plan view of a race course layout with playing pieces and storage locations on it in accordance with one embodiment of the invention to play the game described herein.

The embodiment of the invention in the FIG. 1 shows a race course 11 on a board 12. The race course has several lanes 13–18, each of which has a starting position 19 and a finish line 20 and is divided into a certain number of unit distances, or increments, 21. In the embodiment in FIG. 1, the starting position is adjacent the finish line, but it is not necessary that they be so arranged. It is not even necessary that they extend straight across the track; the starting position and the finish line for each lane may be displaced longitudinally along that lane relative to the starting positions and the finish lines for other lanes. In order to give each player an equal chance, the lanes 13–18 are parallel and there are the same number of increments 21 in each lane.

In this embodiment, six standard, cubical dice 22–27 are used as random-choice generating means. Such dice have from one to six spots on their facets, which allows up to six playing pieces 28–33 to be used, numbered from "1" to "6" travelling in lanes 13–18, respectively. The playing pieces may be indicated by other indicia, such as letters or colors, and the facets of the dice should then be marked accordingly. In this embodiment, the playing pieces 28–33 are illustrated as being toy cars, but other playing pieces may be used instead. More or less than six playing pieces can be used in a game, along with more or less than six lanes, but there should preferably be no more than one playing piece in each lane and no more playing pieces than there are facets on the dice. Special dice can be used having more than six sides, which would allow more than six playing pieces 28–33 and six lanes 13–18 to be used, but, in any event, the playing pieces are marked in such a way that there is a known correspondence between the indicium on each playing piece and that on one of the facets on each die.

The board 12 may have a barrier 34 against which the dice, are to be cast. If there is a barrier, it is preferably somewhat C-shaped to retain the dice in the central area of the board.

The game further includes several storage locations 35–40 marked "1st", "2nd", "3rd", "4th", "5th", and "6th", respectively, each corresponding to one of the six possible finishing positions in a game played with six pieces 28–33. These storage locations are provided as places in which to store value markers. Typically, poker chips are used as value markers, and cups large enough to hold several chips are suitable for use as the storage locations 35–40. The term "chip" will be used hereinafter to refer to any type of value marker.

In preparing to play the game, one of the playing pieces 28–33 is assigned to each player. This may be done in any of several ways, such as by choice or by lot or by having each player, in turn, roll a die. Since all of the lanes 13–18 have the same number of increments 21 and the same number of obstacles, which will be discussed hereinafter, there is no advantage in having one piece rather than another.

If the players choose to have the playing pieces 28–83 allocated by casting a die, the first player to do so will receive the playing piece identified by the indicium on the uppermost surface of the die. Each of the rest of the players in succession will then roll the die as many times as it takes to have it indicate a playing piece not previously allocated to another player.

In accordance with this invention, the game includes triggering means to initiate a special event. One form of triggering means is in the form of shaded increments, or obstacles, 42–45 in the lane 13 and correspondingly shaded increments 42*a–e* through 45*a–e* in the other lanes 14–18. When a playing piece lands on one of these increments, the player to whom that piece has been allocated is required to select one of the storage locations 35–40 and place a poler chip in that location. Another type of triggering means is a set of differently shade increments, or obstacles, 47–49 in lane 13 and corresponding obstacles 47*a–e* through 49*a–e* in lanes 14–18, respectively. When a playing piece lands on one of the latter obstacles, it is required to go back a certain number of increments, for example, two increments. The player may also be required to place another chip in a storage location, not necessarily the same one as before. The players are provided with holders 51–56 to hold poker chips 57.

Another rule to add interest to the game is that, prior to the beginning of play, every player must contribute a poker chip to the storage location 35, the one that corresponds to 1st place.

Play of the game can begin with any one player casting all of the dice for the first turn. Assuming there are six players and that each of them has been given a respective one of the playing pieces 28–33 marked with numerical indicia from "1" to "6", traveling in lanes 13–18, respectively, and that there are six standard, cubical dice 22–27, it is possible for all six dice to come to rest with the same number (of spots) uppermost, but it is much more likely that several different numbers will be uppermost. To take a specific example, three of the dice may 25–27 may show the number 3, one of the dice 22 may show the number 5, and two of the dice 23 and 24 may show the number 6. In that case, the playing piece 30 marked "3" will be moved forward three unit distances, corresponding to the number of dice showing three dots The piece 32 marked "5" will be moved forward one unit distance, corresponding to the fact that only one die indicated a "5", and the playing piece 33 marked "6" will be moved forward two unit distances, corresponding to the fact that two of the dice indicated a "6". The playing pieces marked 2, 3, and 4 will not be moved at all on that turn. When played this way, the number of spots uppermost on one die are not added to those uppermost on any other die.

All of the dice are then passed to the next player for the next turn and are then cast by that player. The same type of movement is made as before, in accordance with the indicia uppermost on the six dice, and the casting continues turn after turn until at least the next-to-the-last piece crosses the finish line 20. As in the first turn and every other turn, a move may be indicated for any one or more of the pieces. It will be noted that, as described, there is no necessary connection between the player casting the dice and the playing piece or pieces moved during a given turn. In fact, one player could do all the casting.

As the game progresses, one of the playing pieces will reach its finish line 20 before any of the others (unless there is a tie), followed, eventually, by each of the other pieces. The player whose piece actually finishes in a certain position relative to the other pieces, i.e., 1st, 2nd, etc., is awarded all of the chips accumulated in the storage location 35 corresponding to that finishing position unless two pieces tie by crossing the finish line on the same throw of the dice. Even then, if one of those pieces goes farther beyond the finish line than the other, it is not considered a tie. Instead, the piece that goes farthest beyond the finish line on that throw wins that position, and the other piece wins the next position If both go the same distance on the turn that takes both of them across the finish line, the total chips for those two positions are divided equally between those two players.

In the absence of a tie, the player whose piece reaches the finish line second wins all of the chips in the location 36, which may have a greater accumulated value than those won by the player whose piece finished first And the player whose piece reaches the finish line 20 third receives all of the chips in location 37, which may well be worth more than those in either location 35 or 36. And so on.

This brings to light one of the most fascinating aspects of the game. Every time a player has to place a chip 57 in one of the locations 35–40, it is to that player's advantage to place it in the location corresponding to the position in which he thinks his playing piece will finish the race. If one piece is well ahead of the others, that player will probably choose to put chips into the location 35 corresponding to 1st place in the hope that he will win all of those chips back if his playing piece does come in 1st. However, there is no assurance that a playing piece in the lead will win. It can sit stationary for any number of turns if its indicium does not show up when the dice are cast. And, until it passes the final obstacle 49–49*e*, it can get caught in a loop, repeatedly landing on that obstacle and being forced to move back two increments. In addition, the player may be drained of all chips and have to abandon the game.

The invention is not limited to the number and types of obstacles shown in FIG. 1, nor to the effect those obstacles have on a piece landing on them It will be noted that, in this embodiment, one triggering location 48 is located two unit distances ahead of one of the triggering location 44 in the lane 13. The same arrangement is also found in each of the other lanes 14–18 for location pairs 48*a*–42*a*, 48*b*–45*b*, 48*c*–43*c*, 48*d*–45*d*, and 48*e*–43*e*. As a result, when the pieces 28–33 land on their respective obstacles 48–48*e*, the respective players are not only forced to put a chip in one of the storage locations but are also forced to deposit a second chip immediately, as the player's piece is forced to go back two increments to the triggering location 44, 42*a*, 45*b*, 43*c*, 45*d*, or 43*e*, respectively. Since each piece is most likely to move only one or two unit distances at a turn, it is entirely possible for a piece caught by any of the triggering location 47–49*e* to have to cycle several times before it can 45*a–e* in the other lanes 14–18. When a playing piece lands on one escape. The obstacles 47–47*e* and 49–49e are placed alongside each other in this embodiment, but the other obstacles are not.

Figure 2:
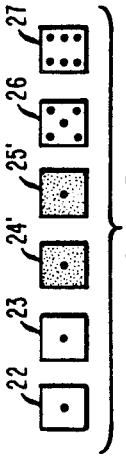
FIG. 2 shows another embodiment of dice for use in the game.

FIG. 2 shows dice 24' and 25' with some other indicia, such as color, on them. In the drawing, this is indicated by shading those dice. Dice 22, 23, 26, and 27 remain the same as in FIG. 1. The dice 24' and 25' can be used as triggering means to cause a piece 28–33 to have to do something other than move forward For example, it may have to move backward. To illustrate, if three of the dice 22, 23, and 25, show a "1", and dice 24', 26, and 27 show "3" "5", and "6", respectively, the playing piece 28 marked "1" in the first lane 13 will move two unit distances forward and one back, for a net gain of 1 the playing piece 30 marked "3" in lane 15 will have to move backward one space, and each of the pieces 32 and 33, marked "5" and "6", respectively, will move forward one increment. This may cause the piece 28 to land on the triggering location 48 and will exact a chip from the player owning the piece 28 and a second chip when that same piece is immediately forced back to the increment 43.

Figure 3:
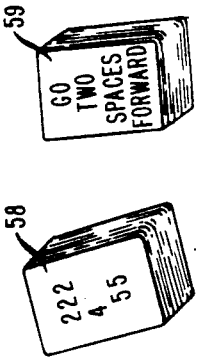
FIG. 3 shows another embodiment of random-choice generating means for producing movement information.

It is to be understood that, in place of dice, other types of random-choice generating means can be used, such as other mechanical random generators and computers. FIG. 3 shows two examples of cards 58 and 59 that may be used in playing the game. The stack of cards 58 can be shuffled at the start of a game and selected one at a time as random-choice generating means to produce information to control movement of the playing pieces. The face of the card 58 that is completely visible shows three 2's, a 4, and two 5's, indicating, as in the case of the dice, that the piece marked "2" is to move three increments, the piece marked "5" is to move two increments, and the piece marked "4" is to move one increment for a total of six increments. This corresponds to one increment per die in the embodiment illustrated in FIG. 1. As in the type of play described in connection with FIG. 2, any of the numbers on the card 58 can be printed in a different color to trigger off a different move--or none at all. The numbers printed on the cards 58 can be selected on the same probability as they would be generated by dice, if it is desired to make the play of the game using cards the same as it would be using dice Furthermore, cards 58 make it easier to provide more than six lanes, since there is no fixed limit to the number of numbers that can be printed on those cards. If there are n lanes, each having one playing piece, there can be from O to n numbers of increments indicated for O to n playing pieces This is in accordance with the desirability of simultaneously and randomly generating the same number of indicia as the number of playing pieces. This allows all of the playing pieces 28–33 indicated by a card to be moved substantially simultaneously so that it will be easy for all of the players to see that all necessary movements are made each turn.

The cards 59 are cards that a player could be required to select in response to some triggering event, such as having one of the differently colored dice 24, or 25, in FIG. 2 show the number of that player's playing piece, or having the player's piece land on one of the obstacles 42–45e.

While specific arrangements of the board 12 and the equipment used on or with it have been illustrated by specific embodiments and rules of play, it is to be understood that modifications can be made in them that will still be within the scope of this invention.

What is claimed is:

1. The method of playing a game comprising the steps of:

(a) providing a display having a race course comprising a starting position and a finish line and incremental areas along its length;

(b) providing a plurality of playing pieces, each having unique indicating means and each traveling along the course from the starting position to the finish line;

(c) providing a plurality of random-choice means to be operated time after time during the game for randomly indicating indicia each time from a plurality of indicia, each of the randomly indicated indicia being representative of a specific one of the playing pieces, each indicated playing piece being moved along its lane according to information produced by the random-choice means that indicate that playing piece;

(d) providing a plurality of scoring markers;

(e) providing a plurality of storage locations for storing said scoring markers, each storage location corresponding to a finishing position choice;

(f) providing a plurality of triggering means on said race course;

(g) requiring a player whose playing piece lands on a triggering means to choose one of the storage locations and to increment a number of scoring markers in the chosen storage location, each player being awarded the final incremented number of markers in the storage location that corresponds to the finishing position in which that player's piece crosses the finish line relative to the other playing pieces.

2. The method of playing the game of claim 1 in which the race course is divided into a plurality of lanes, and each playing piece travels in only one of the lanes.

3. The method of playing the game of claim 2 in which each lane has a plurality of triggering means spaced apart along it.

4. The method of playing the game of claim 1 in which the random-choice means comprise a plurality of dice, each having a plurality of facets with a selected one of the indicia on each facet.

5. The method of playing the game of claim 4 in which the dice have visibly different characteristics from each other, and the response to be made by any playing piece whose indicium is displayed uppermost on one o the dice when the dice are cast depends on the visible characteristics of that die.

6. The method of playing the game of claim 5 in which the visibly different characteristics are colors.

7. The method of playing the game of claim 6 in which at least one of the dice is of a color different from the rest of the dice.

8. The method of playing the game of claim 6 in which a playing piece with a certain indicium is to be moved forward a predetermined number of elemental areas when a die of one color lands with its uppermost facet having the same indicium, and said playing piece is to be moved differently when a die of another color lands with its uppermost facet having the same indicium.

9. The method of playing the game of claim 8 in which said playing piece is to be moved backward when a die of another color lands with its uppermost facet having said indicium.

10. The method of playing the game of claim 1 in which the random-choice means comprise a plurality of cards, each having indicia on them corresponding to indicia on at least one o the playing pieces.

11. The method of playing the game of claim 1 in which the triggering means are selected ones of the incremental areas.

12. The method of playing the game of claim 11 in which most of the incremental area are of one color and a small fraction of the incremental areas are of a second color.

13. The method of playing the game of claim 12 in which a second small fraction of the incremental areas are of a third color.

14. The method of playing the game of claim 11 in which certain of the incremental areas require a playing piece that lands on them to go backward a selected number of incremental areas.

15. The method of playing the game of claim 11 in which the race course is divided into a plurality of lanes, each lane having a plurality of triggering means spaced apart along it, and each playing piece travels in only one of the lanes.

16. The method of playing a game comprising the steps of claim 15:

(a) providing a board displaying a multi-lane race course with a starting position and a finish line, the lanes being divided into incremental areas;

(b) providing a plurality of playing pieces, each having a number thereon;

(c) assigning each of the pieces to a respective player for the duration of the game;

(d) providing a plurality of dice equal in number to the plurality of playing pieces, all of the dice being thrown each turn for selecting a plurality of random numbers at each turn, each of the random numbers corresponding to the number on a specific one of the playing pieces, each playing piece being moved from incremental area to incremental area along its lane according to the number of dice displaying the number of that playing piece;

(e) providing a plurality of storage means for storing markers, each said storage means corresponding to a finishing-position choice; and (f) providing selected incremental areas in each lane, each of said incremental areas constituting a triggering location; and (g) requiring a player whose playing piece lands on a triggering location to select one of the storage means corresponding to a finishing-position choice and to increment a number of scoring markers in the selected storage means, each player being awarded the final incremented number of markers in the storage means corresponding to the finishing position in which that player's piece crosses the finish line.

17. The method of playing the game of claim 16 in which the random-choice means comprise a plurality of dice, each of the dice having a plurality of facets with a selected one of the indicia on each facet, and each of the dice having visibly different characteristics from each other, the response to be made by any playing piece whose indicium is displayed uppermost on one of the dice when the dice are cast depending on the visible characteristics of that die.

18. The method of playing the game of claim 17 in which the visibly different characteristics are colors, at least one of the dice being of a color different from the rest of the dice.

19. The method of playing the game of claim 16 comprising the additional step of requiring a playing piece with a certain indicium to be moved forward a predetermined number of elemental areas when a die of one color lands with its uppermost facet having the same indicium, and requiring said playing piece to be moved differently when a die of another color lands with its uppermost facet having the same indicium.

20. The method of playing the game of claim 16 in which the random-choice means comprise a plurality of cards, each having indicia on them corresponding to indicia on at least one o the playing pieces.

* * * * *